United States Patent [19]

Bower, Jr.

[11] 4,451,179

[45] May 29, 1984

[54] METHOD AND APPARATUS FOR AFFIXING A ROOF BOLTING PLATE TO A MINE ROOF

[75] Inventor: Arnold B. Bower, Jr., Bristol, Va.

[73] Assignee: Hughes Tool Company, Houston, Tex.

[21] Appl. No.: 102,279

[22] Filed: Dec. 10, 1979

[51] Int. Cl.[3] ..... E21D 20/02

[52] U.S. Cl. ..... 405/260; 29/526 R; 175/220

[58] Field of Search ..... 405/259–262; 408/110, 111; 175/219, 220; 29/526

[56] References Cited

U.S. PATENT DOCUMENTS 3,842,610 10/1974 Willis et al. ..... 405/259
4,033,419 7/1977 Pennington ..... 405/259

FOREIGN PATENT DOCUMENTS 197708 8/1977 U.S.S.R. ..... 405/259

*Primary Examiner*—Ernest R. Purser
*Attorney, Agent, or Firm*—Hedman, Gibson, Costigan & Hoare

[57] ABSTRACT

A drive rod centralizer suitable for use with a roof bolting drill is described. A roof bolting drill, which includes a drive rod mounted on a drive head, has a support frame connected thereto that is disposed over the drive rod. The support frame includes a plurality of supporting members which are positioned such that a roof bolting plate or board may be slidably received within the supporting members whereby the central bolt hole of the bolting plate is aligned with the drive rod of the roof bolting drill. By this arrangement, the drive rod passes through and is guided by the bolt hole in the plate, thereby centralizing the drive rod during a drilling operation.

5 Claims, 2 Drawing Figures

METHOD AND APPARATUS FOR AFFIXING A ROOF BOLTING PLATE TO A MINE ROOF

This invention relates to a process for affixing a roof bolting plate to a mine roof and an apparatus including a roof bolting drill having a centralizer for the tool steel driver element. More particularly, the roof bolting drill, which includes a tool steel driver element connected to a drive head, is provided with a support frame connected thereto that is disposed over the drive element. The supporting frame includes a plurality of supporting members which are positioned such that a roof bolting plate or board having a central bolt hole therein, may be slidably received on the support frame, with the central bolt hole of the plate being aligned with the driver element of the bolting drill. By this arrangement, during a drilling operation the tool steel driver element passes through and is guided by the bolt hole in the roof bolting plate, thereby centralizing the driver element.

BACKGROUND OF THE INVENTION

It is well known that in mining operations it is necessary for the safety of the miners to have a comprehensive roof control system. More particularly, it is necessary that a support structure be installed along the mine roof to minimize the likelihood of a cave in. To this end, roof bolting systems have been employed wherein plates or boards are affixed to the mine roof, thereby shoring the roof and protecting against a cave in. To affix the plates or boards to the mine roof, an operator first drills a hole in the mine roof and then, while hand holding a plate against the roof, affixes the plate or board to the roof by a bolt. The attachment may be accomplished either by utilizing a conventional mechanical bolt or by employing a resin bolting system wherein a fast curing resin is placed in the bolt hole followed by the bolt such that the resin hardens and secures the bolt in the hole thereby affixing the plate to the mine roof.

Many roof bolting drills have been developed in the prior art for drilling the bolt holes in a mine roof. The prior art drills are equipped with a rotating drive head into which is mounted a tool steel driver element or drive rod. Depending upon the type of rock which is being drilled, one of a variety of drill bits is affixed to the opposite end of the drill rod. During a drilling operation, the drill bit is positioned adjacent the mine roof whereupon the drill head rotates the drill steel at high speeds enabling the bit to cut into the mine roof. During the drilling operation, the drill head of the roof bolting drill is mechanically raised until a hole of the required depth is obtained. Holes of five feet or greater in depth are commonly employed.

A number of difficulties have been encountered when drilling bolt holes in this manner. As an example, if the drill steel happens to be bent slightly or crooked, the bit end near the roof will "whip" around in an unsafe manner until the hole is collared and drilling is started. Further, an operator is often forced to keep one hand on the rotating drill steel to prevent it from oscillating out of the vertical position. In addition, if the drill steel happens to be slightly bent or crooked, vertical alignment of the drill steel is also prevented. Vertical misalignment may also occur due to the misjudgment of the operator. Misalignment of the drill steel will frequently result in breakage of the steel as the drill head is raised towards the roof line. For example, when a five foot length of drill steel is initially aligned, a one degree misalignment from the vertical will result in a one inch horizontal displacement of the drill steel at the roof line. During the same drilling operation, at a point when the drill head has been raised four feet from its initial position, the remaining twelve inches of the drill steel will be 5 degrees out of vertical alignment. This misalignment creates a strain on all the components of the system and breakage of the drill steel can easily occur.

To obviate the shortcomings of the roof bolting drill machines of the prior art, jaw-like devices were developed which mechanically opened and closed to grip and centralize the drill steel. However, these devices often operated improperly due to poor construction and/or maintenance problems. In addition, these devices are not adapted to be used in conjunction with a roof bolt plate or board. Thus, after the bolt hole was drilled, the operator was required to lower the centralizing device, and then hand hold the roof bolt plate up to the mine roof to complete the roof bolt plate installation.

Therefore, it is an object of the present invention to obviate the shortcomings of the prior art to provide a roof bolting drill machine which is equipped with a drill rod centralizer which will accurately align a drill steel element in a vertical position.

It is a further object of the subject invention to provide a drill rod centralizer which will mechanically support a roof bolt plate adjacent the mine roof.

It is another object of the subject invention to provide a drill rod centralizer which prevents unsafe whipping of the drill rod at the initiation of the drilling operation.

DESCRIPTION OF THE INVENTION

Figure 1:
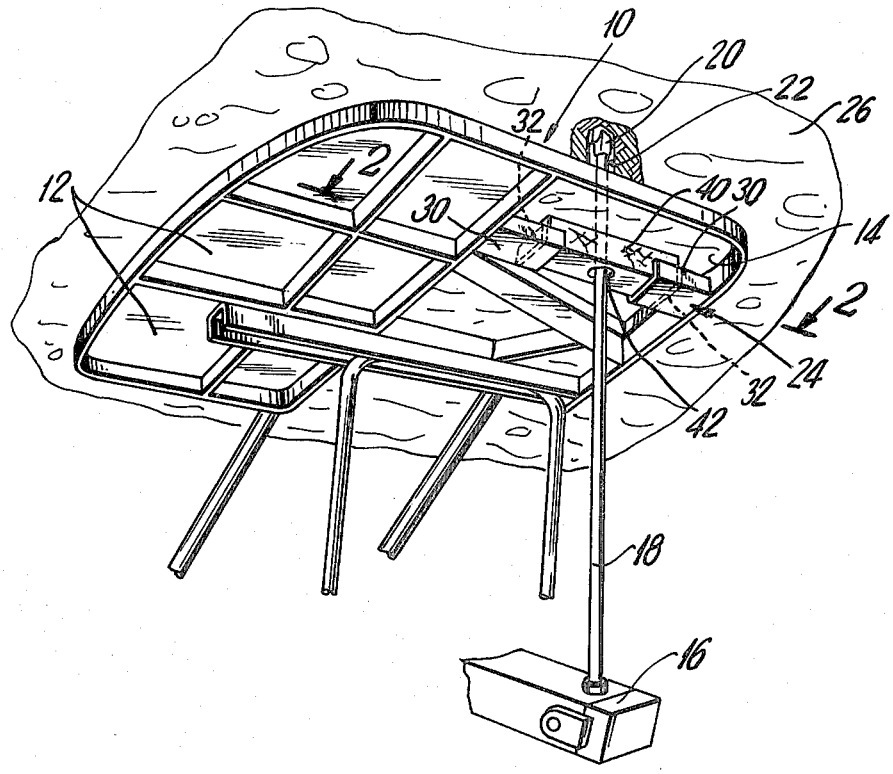
FIG. 1 is a perspective view of a protective canopy of a roof bolting drill machine and illustrating the drill rod centralizer of the subject invention.

According to the subject invention there is provided a tool steel driver or drive rod centralizer for a roof bolting drill. More particularly, a support frame which is connected to a conventional roof bolting drill is provided with a plurality of supporting members into which a roof bolting plate or board may be slidably received.

A conventional roof bolting plate or board is generally rectangular in configuration and has a central bolt hole by which it is secured to a mine roof by a bolt. The roof bolting plate functions to shore up a mine roof, thereby inhibiting its collapse. According to the subject invention, the supporting members affixed to the support frame of the roof bolting drill are positioned such that when the roof bolting plate is slidably received therein, the central bolt hole of the plate is vertically aligned with the tool steel driver and drive head of the roof bolting drill. By this arrangement, during a drilling operation the drive rod and the attached drill bit pass through the central bolt hole of the roof bolting plate and are guided thereby into an aligned and vertical position. After the hole is drilled, the operator may retract the drive rod leaving the roof bolting plate braced against the mine roof by the support frame of the roof bolting drill. The operator, without having to hand hold the plate, may then simply insert a mechanical expansion roof bolt through the bolt hole, thereby affixing the plate to the mine roof. In the alternative, a resin capsule may be inserted into the pre-drilled hole followed by a bolt member for creating a resin bolting system. Once the plate is attached to the roof, the support frame is lowered and another board or plate is set into the supporting frame whereupon the supporting frame is then raised to the roof line so that another drilling operation may be initiated.

By law, roof bolting drills must be provided with a protective canopy to minimize the dangers to the operator from falling rocks. A conventional protective canopy is generally provided with a rectangularly shaped open area through which the tool steel driver passes during a drilling operation. In accordance with the subject invention, and in order to minimize costs, it is suggested that the protective canopy be utilized to function as the support frame onto which the supporting members for the roof bolting plate may be affixed. More specifically, the supporting members for the roof bolting plate may be affixed to the protective canopy in the area of the generally rectangular opening. The roof bolting plate may then be slidably received within the supporting members prior to the commencement of a drilling operation. Thus, the central bolt hole of a conventional roof bolting plate is utilized as a centralizer during the drilling operation, and by this arrangement, the tool steel driver is precisely vertically aligned. Further, since the tool steel driver is guided by the central bolt hole of the roof bolting plate, unsafe whipping of the tool steel driver which usually occurs at the initiation of the drilling operation is minimized and, in addition, the operator is not forced to hand hold the drive rod. Also, since the roof bolting plate is positioned and mechanically supported against the roof line during the entire drilling operation, it does not have to be braced by hand against the mine roof by the operator, as was heretofore done in bolting techniques according to the prior art. Thus, the subject invention, in addition to vertically aligning the drive rod, substantially reduces the risk of injury to the operator of the drill.

DESCRIPTION OF THE PREFERRED EMBODIMENT

Figure 2:
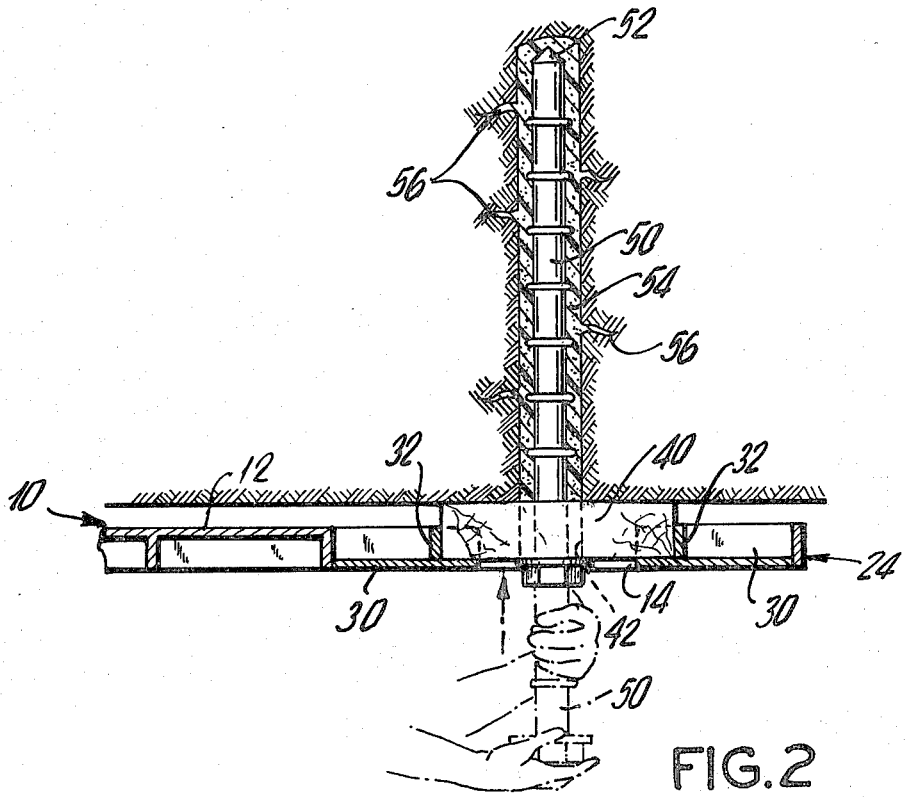
FIG. 2 is a cross sectional view, taken along line 2—2 in FIG. 1, and illustrating the attachment of a roof bolt plate to the mine roof.

A conventional protective canopy 10 attached to a roof bolting drill (not shown) is illustrated in FIGS. 1 and 2. Covered areas 12 serve to protect the drill operator from chips of falling rock. An open area 14 is provided which is generally aligned with the drill head 16 so that a tool steel driver 18 may pass therethrough unimpeded to the roof. During a drilling operation, the drill head 16 is mechanically raised towards the mine roof 26 as the drill bit 20 bores a hole 22 into the mine roof 26 to the desired depth. As noted above, in the prior art if the tool steel driver 18 is bent or if the roof bolting machine is improperly maintained, or even if the operator makes an error in judgement, the tool steel driver will not be vertically aligned. Since even a small initial misalignment would result in a large angular displacement from the vertical as the drill head 16 is raised towards the canopy 10, a severe strain on all the components of the roof bolting drill would occur which frequently results in the breakage of the tool steel driver 18. Further, even if the tool steel driver is vertically aligned, problems arise at the initiation of the drilling operation in that the drill bit 20 will often whip around in an unsafe manner until the hole is collared or started.

In accordance with the subject invention, a roof drill centralizer, indicated generally by the numeral 24, is provided and functions to prevent whipping of the drill bit 20 during the initiation of the drilling operation and in addition, provides vertical alignment of the tool steel driver 18. As illustrated in FIG. 1, supporting members 30 are affixed to the support frame adjacent the open area 14 of the protective canopy 10. While the support members 30 are illustrated as generally trough-like in configuration, it is intended that any support member which similarly functions to slidably receive and position a roof bolting plate be included within the scope of the subject invention.

The support members 30 are provided with flanges 32 for centering a roof bolting plate 40 and preventing the longitudinal shifting of the plate during a drilling operation. The width of supporting members 30 is slightly larger than the width of the roof bolting plate 40 so that the plate 40 can be slidably received therein but cannot shift laterally during a drilling operation. A separation is provided between the supporting members 30 to allow clearance for the driver 18. The roof bolting plate 40 is shown slidably received within the supporting members 30 and bridging the separation therebetween. The supporting members 30 and the integral flanges 32 are positioned such that the central bolt 42 in the roof bolting plate 40 is vertically aligned with the drive head 16. By this arrangement, the tool steel driver 18 may pass through the central bolt 42 and be guided thereby.

Prior to the initiation of a drilling operation, a conventional roof bolting plate 40 is slidably mounted onto the supporting members 30 of the protective canopy 10. In the next step in the subject process, the protective canopy is raised such that the top surface of the roof bolting plate is substantially flush with the mine roof 26. A tool steel driver 18 with a tungsten carbide bit 20 is mounted in the drill head 16. The drill head 16 is raised to a height sufficient such that the bit 20 and the tool steel driver 18 pass through the central bolt hole 42 in the roof bolting plate 40 until the bit reaches the mine roof 26. At this point, the drilling operation begins with the drill head 16 rotating the tool steel driver enabling the bit 20 to bore into the mine roof 26 creating the hole 22. During the drilling operation, the drill head 16 is mechanically raised upwardly allowing the bit 20 to progressively drill a deeper hole. When the desired depth is reached, the drilling is stopped and the drill head 16 and the drive rod 18 are lowered until the bit 20 emerges from the hole 22 and is withdrawn through the central bolt hole 42 of the roof bolting plate 40.

The roof bolting plate 40 may then be permanently affixed to the mine roof 26 by either mechanical bolting or through the use of a resin bolting system. In a resin bolting system, and as illustrated in FIG. 2, a resin package (not shown) having frangible walls and containing a polyester resin and a catalyst is placed in the hole 22. A bolt 50, having a tapered end 52, is then pushed upwardly into the hole 22, thereby rupturing the frangible walls of the resin bolting package. To facilitate the mixing of the contents of the resin package, the bolt 50 is usually rotated either by hand or mechanically by the roof bolting drill. Curing and setting of the two part plastic system 54 is very rapid, with the plastic system 54 filling in the cracks 56 in the wall of the hole 22, and forming a bond with the bolt 50 thereby securing roof bolting plate 40 to the mine roof 26. Thereafter the protective canopy is merely lowered away from the roof 26 leaving the bolt 50 and plate 40 affixed to the roof 26. By this arrangement, the operator is freed from manually holding the roof bolting plate 40 against the mine roof 26 with one hand while attempting to insert the resin package and the bolt 50 into the bolt hole 42 with the other hand. Before initiating a second drilling operation, it is merely necessary for the operator to slidably insert another roof bolting plate onto the supporting members 30 preparatory to drilling another hole.

Accordingly, there is provided a new and improved roof bolting drill having a tool steel driver centralizer consisting of a support frame connected to the roof bolting drill and disposed over the drive head. A plurality of supporting members are affixed to the support frame and are positioned such that a roof bolting plate may be slidably received therein, with the central bolt hole of the plate being aligned with the drive head and the tool steel driver. By this arrangement, in the subject process, during a drilling operation the driver element passes through and is guided by the bolt hole in the plate which thereby functions to vertically align the driver element and in addition, prevents the unnecessary and unsafe whipping of the drill bit generally occuring at the initiation of the drilling operation.

It is to be understood that changes may be made in the particular embodiment of the invention in light of the above teachings, but that these will be within the full scope of the invention as defined by the appended claims.

I claim:

1. A roof bolting drill having a driver element centralizer comprising:

a roof bolting drill including a driver element;

a support frame connected to said roof bolting drill and disposed over said driver element;

a roof bolting plate having a central bolt hole therein; and a plurality of supporting members having a generally trough-like configuration including a flange member extending transversely therein and disposed intermediate the length of said members such that said roof bolting plate is prevented from shifting longitudinally during a drilling operation, said supporting members being affixed to said support frame, said roof bolting plate being slidably received within said supporting members with said central bolt hole being aligned with said driver element whereby during a drilling operation said driver element passes through and is guided by the bolt hole in said plate which thereby functions to centralize the driver element.

2. A roof bolting drill as recited in claim 1 wherein said support frame is canopy shaped in configuration and includes a covered area and an uncovered area, said uncovered area being vertically aligned with said driver element, and with said covered area functioning to shield the operator from falling rock chips during a drilling operation.

3. A roof bolting drill as recited in claim 2 wherein said supporting members, affixed to said support frame, are disposed adjacent said uncovered area of said support frame.

4. A roof bolting drill as recited in claim 1 wherein said trough-like supporting members have a width slightly larger than the width of said roof bolting plate such that the roof bolting plate may be slidably mounted therein and prevented from lateral shifting during a drilling operation.

5. A method of affixing a roof bolting plate having a central bolt hole to a roof using a roof bolting drill having a driver element, with the roof bolting drill further including a support frame having a plurality of supporting members having a generally trough-like configuration including a flange member extending transversely therein and disposed intermediate the length of said members such that said roof bolting plate is prevented from shifting longitudinally during a drilling operation, said support members being positioned such that when a roof bolting plate is slidably received within said supporting members, the central bolt hole of the roof bolting plate is aligned with the driver element of the roof bolting drill, said method comprising the steps of:

mounting a roof bolting plate between said supporting members on said support frame;

raising said support frame until the upper surface of the roof bolting plate abuts the roof;

raising the driver element such that it passes through and is guided by the central bolt hole of said roof bolting plate;

drilling a hole in the roof to the desired depth;

lowering the driver element until the upper end thereof is below the bottom surface of said roof bolting plate;

placing a bolt through the central bolt hole of the roof bolting plate and into the drilled hole;

securing the bolt and the roof bolting plate to the roof; and lowering the support frame thereby leaving the bolt and the roof bolting plate affixed to the roof.

* * * * *